US011346039B2

(12) United States Patent
Park et al.

(10) Patent No.: US 11,346,039 B2
(45) Date of Patent: May 31, 2022

(54) DOOR ASSEMBLY FOR A LAUNDRY TREATING APPLIANCE

(71) Applicant: WHIRLPOOL CORPORATION, Benton Harbor, MI (US)

(72) Inventors: Jun Young Park, Benton Harbor, MI (US); Seth E. Bixby, Stevensville, MI (US); Dario Grasselli, Travedona-Monate (IT); Andrew C. Kubasiak, Saint Joseph, MI (US); Giuseppe Netti, Osmate (IT); Anna C. Schelling, Stevensville, MI (US); Sayer J. Murphy, Saint Joseph, MI (US); Gregg P. Fitzgerald, Eau Claire, MI (US); Biagio Ludovico, Milan (IT)

(73) Assignee: Whirlpool Corporation, Benton Harbor, MI (US)

( * ) Notice: Subject to any disclaimer, the term of this patent is extended or adjusted under 35 U.S.C. 154(b) by 76 days.

(21) Appl. No.: 16/859,425

(22) Filed: Apr. 27, 2020

(65) Prior Publication Data

US 2020/0354878 A1 Nov. 12, 2020

Related U.S. Application Data

(60) Provisional application No. 62/844,913, filed on May 8, 2019.

(51) Int. Cl.

| | |
|---|---|
| ***D06F 39/08*** | (2006.01) |
| ***D06F 29/00*** | (2006.01) |
| ***D06F 37/04*** | (2006.01) |
| ***D06F 39/14*** | (2006.01) |

(52) U.S. Cl.
CPC ..... *D06F 39/088* (2013.01); *D06F 29/00* (2013.01); *D06F 37/04* (2013.01); *D06F 39/14* (2013.01)

(58) Field of Classification Search
CPC ..... D06F 39/088; D06F 39/14; D06F 29/00; D06F 37/04
USPC ..... 68/207
See application file for complete search history.

(56) References Cited

U.S. PATENT DOCUMENTS

| | | | | |
|---|---|---|---|---|
| 5,357,772 | A | 10/1994 | Hendren | |
| 5,546,773 | A * | 8/1996 | Lee | D06F 39/14 68/196 |
| 10,053,811 | B2 | 8/2018 | Kim et al. | |
| 10,184,200 | B2 | 1/2019 | Wishney et al. | |
| 2016/0369445 | A1 | 12/2016 | Kim et al. | |

(Continued)

FOREIGN PATENT DOCUMENTS

| | | |
|---|---|---|
| CA | 2943973 | 9/2016 |
| CN | 200967894 Y | 10/2007 |

(Continued)

*Primary Examiner* — Tinsae B Ayalew
(74) *Attorney, Agent, or Firm* — McGarry Bair PC

(57) ABSTRACT

A laundry treating appliance includes a chassis defining an interior and having a front panel defining a front panel opening. A rotatable treating chamber is located within the interior and accessible through the front panel opening. A door assembly is movably mounted to the chassis for movement between opened and closed positions to selectively open or close the front panel opening. A compartment is movably mounted to the door assembly for movement between opened and closed positions. A basin is carried by the compartment between an accessible position and a non-accessible position.

20 Claims, 7 Drawing Sheets

(56) References Cited

U.S. PATENT DOCUMENTS

| | | | |
|---|---|---|---|
| 2017/0137985 | A1 | 5/2017 | Kim |
| 2018/0038040 | A1 | 2/2018 | Kim et al. |
| 2018/0179687 | A1 | 6/2018 | Chun et al. |
| 2018/0179690 | A1 | 6/2018 | Cheon et al. |
| 2018/0251928 | A1 | 9/2018 | Lee et al. |
| 2018/0258576 | A1 | 9/2018 | Kim et al. |
| 2019/0003106 | A1 | 1/2019 | Lee et al. |
| 2019/0010650 | A1 | 1/2019 | Xu et al. |

FOREIGN PATENT DOCUMENTS

| | | | |
|---|---|---|---|
| CN | 201132900 | Y | 10/2008 |
| CN | 104805630 | A | 7/2015 |
| CN | 104963160 | A | 10/2015 |
| CN | 206245077 | U | 6/2017 |
| CN | 106978696 | A | 7/2017 |
| CN | 107022865 | A | 8/2017 |
| CN | 107385766 | A | 11/2017 |
| EP | 1389643 | A2 | 2/2004 |
| EP | 1522625 | A1 | 4/2005 |
| EP | 2415921 | A1 | 2/2012 |
| EP | 2843107 | A1 | 3/2015 |
| EP | 3184689 | A1 | 6/2017 |
| EP | 2930263 | B1 | 8/2017 |
| EP | 3249092 | A1 | 11/2017 |
| EP | 3339495 | A1 | 6/2018 |
| EP | 3339497 | A1 | 6/2018 |
| EP | 3339488 | B1 | 4/2019 |
| EP | 3339498 | B1 | 4/2019 |
| KR | 20090096948 | A | 9/2009 |
| KR | 20170105201 | A | 9/2017 |
| WO | 2008052984 | A1 | 5/2008 |
| WO | 2016137156 | A1 | 9/2016 |
| WO | 2017026711 | A1 | 2/2017 |
| WO | 2017030317 | A1 | 2/2017 |
| WO | 2017034197 | A1 | 3/2017 |
| WO | 201799404 | A1 | 6/2017 |
| WO | 2017107940 | A1 | 6/2017 |
| WO | 2017111352 | A1 | 6/2017 |
| WO | 2017142249 | A1 | 8/2017 |
| WO | 2018117415 | A1 | 6/2018 |
| WO | 2018141914 | A1 | 8/2018 |

* cited by examiner

DOOR ASSEMBLY FOR A LAUNDRY TREATING APPLIANCE

CROSS-REFERENCE TO RELATED APPLICATIONS

This application claims the benefit of U.S. Provisional Patent Application No. 62/844,913, filed on May 8, 2019, which is incorporated herein by reference in its entirety.

FIELD OF THE DISCLOSURE

The current disclosure generally relates to a laundry treating appliance comprising a door assembly. More specifically, the door assembly includes a door within a door configuration, where an inner door is openable/closeable relative to an outer door.

BACKGROUND

Traditionally, pretreatment of laundry items prior to washing is performed in a sink, tub, bucket, or other suitable location that is separate from the laundry treating appliance. Pretreatment can require a water source or treating chemistries separate from a laundry treating appliance making pretreatment both inconvenient and time consuming. Transporting the pretreated laundry items from the pretreatment location to a tub contained within the laundry treating appliance can also provide challenges or frustration to a user. The transporting of the pretreated laundry items includes some type of transporting device or the possibility of dripping water or treating chemistries on the floor or surrounding area.

If such a pre-treated item is to be added to a laundry treating appliance after the initiation of the cycle of operation, the user must stop the cycle and unlock the door to permit the loading of the pre-treated item into the laundry treating appliance.

BRIEF DESCRIPTION

In one aspect, the present disclosure relates to a laundry treating appliance comprising a chassis defining an interior and having a front panel defining a front panel opening, a rotatable treating chamber located within the interior and accessible through the front panel opening, a door assembly movably mounted to the chassis for movement between opened and closed positions to selectively open or close the front panel opening, a compartment movably mounted to the door assembly for movement between opened and closed positions, and a basin carried by the compartment such that, when the compartment is in the opened position, the basin is in an accessible position where the basin is open to an exterior of the door assembly and laundry items can be loaded into the basin, and when the compartment is in the closed position, the basin is in a non-accessible position, where the basin is open to the treating chamber.

In another aspect, the present disclosure relates to a laundry treating appliance comprising a chassis defining an interior and having a front panel defining a front panel opening, a rotatable treating chamber located within the interior and accessible through the front panel opening, a door assembly movably mounted to the chassis for movement between opened and closed positions to selectively open or close the front panel opening, the door assembly comprising a compartment movably mounted to the door assembly for movement between opened and closed positions, a basin carried by the compartment such that, when the compartment is in the opened position, the basin is in an accessible position where the basin is open to an exterior of the door assembly and laundry items can be loaded into the basin, and when the compartment is in the closed position, the basin is in a non-accessible position where the basin is open to the treating chamber, and a deflector body extending between the door assembly and the basin when the basin is in the accessible position to discourage fluids or objects from entering or exiting the treating chamber even during a cycle of operation.

DETAILED DESCRIPTION

A rotatable compartment can provide a convenient space for the pretreatment of laundry items. When in an open position, the rotatable compartment can allow a user access to a basin that is coupled to the rotatable compartment. Optionally, a prewash faucet or a prewash chemistry outlet can be located above the basin. Once pretreatment is complete and the rotatable compartment is closed, the laundry treating items, fluids, or treating chemistries within the basin are transferred to the tub of the laundry treating appliance.

The rotatable compartment can also be used to add laundry items to a cycle of operation that is already in process. The rotatable compartment can be coupled to the door assembly of laundry treating appliance so that the rotatable compartment can be opened without stopping the cycle of operation. Laundry items can be added to the rotatable compartment and transferred to a tub within the laundry treating appliance by closing the rotatable compartment.

Figure 1:
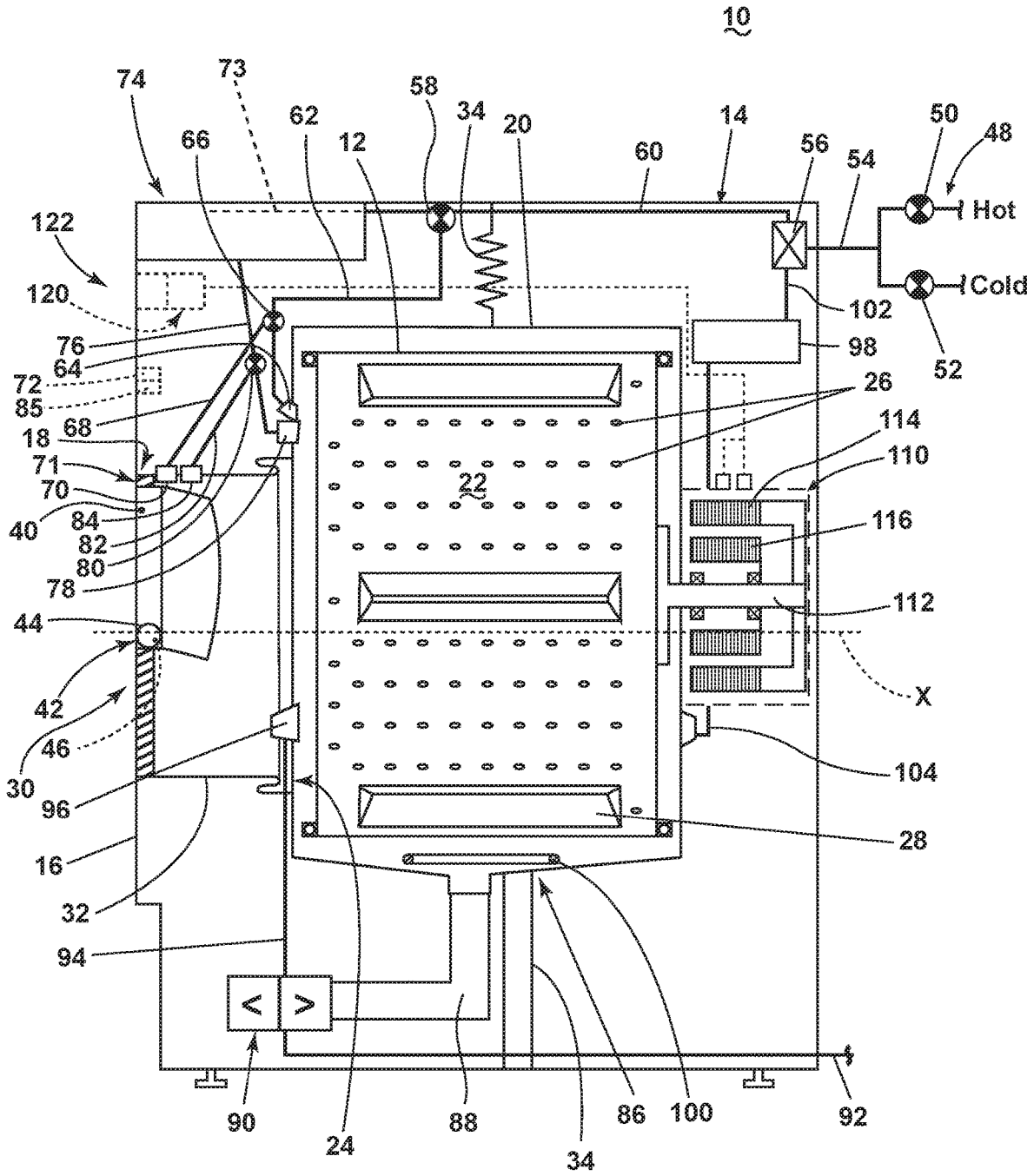
FIG. 1 is a schematic view of a laundry treating appliance in the form of a washing machine with a door assembly.

FIG. 1 is a schematic view of a laundry treating appliance 10 according to aspects of the present disclosure. The laundry treating appliance 10 can be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 of FIG. 1 is illustrated as a horizontal axis, front-load laundry treating appliance 10, the aspects of the present disclosure can have applicability in laundry treating appliances with other configurations. Depending on the configuration, it is possible for the aspects of the present disclosure to have applicability in other appliances having a door, whether it be hinged, slidable, or otherwise attached to a cabinet, with access to a treating chamber.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforated or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforated, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 of FIG. 1 is illustrated as a horizontal-axis laundry treating appliance 10, which can include a structural support system including a cabinet 14, which defines a housing within which a laundry holding system resides. The cabinet 14 can be a housing having a chassis and/or a frame, to which decorative panels can or cannot be mounted, defining an interior enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure. The cabinet 14 can include a front panel 16 that defines a front panel opening 18 to allow user access to the interior of the cabinet 14.

The laundry holding system of the illustrated laundry treating appliance 10 can include a tub 20 supported within the cabinet 14 by a suitable suspension system, the tub 20 at least partially defining a rotatable treating chamber 22 for laundry items. A drum 12 can be provided within the tub 20 to further define at least a portion of the treating chamber 22. The treating chamber 22 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket. The front panel opening 18 can provide access to the treating chamber 22. The drum 12 can be either imperforated or perforated, including a plurality of perforations 26 such that liquid can flow between the tub 20 and the drum 12 through the perforations 26. A plurality of baffles 28 can be disposed on an inner surface of the drum 12 to lift the laundry load received in the treating chamber 22 while the drum 12 rotates. It will be understood that it is also within the scope of the present disclosure for the laundry holding system to comprise only the tub 20, without a drum, to define the treating chamber 22. The laundry treating appliance 10 can further include a suspension system 34 for dynamically suspending the laundry holding system within the structural support system.

The tub 20 can also define a tub opening 24, which can be at least partially aligned with the front panel opening 18 of the cabinet 14. In one example, the tub 20, along with the tub opening 24, the drum 12, and the front panel opening 18 can have central axes that are co-axial with one another, or with at least one of the other axes, such that a common central axis X is formed. Optionally, and especially in the case that the laundry treating appliance 10 is provided as a washing machine, rather than a clothes dryer, a bellows 32 can extend between the tub opening 24 and the front panel opening 18 to couple the front panel opening 18 of the cabinet 14 with the tub opening 24 of the tub 20. The bellows 32 can sealingly couple the tub opening 24 and the front panel opening 18 such that liquid is not permitted to move from the tub 20 into the interior of the cabinet 14.

A door assembly 30 can be included with the laundry treating appliance 10. The door assembly 30 can be movably mounted or coupled to the cabinet 14. By way of non-limiting example, the door assembly 30 can be hingedly coupled to the cabinet 14 for movement between an open position and a closed position to selectively open or close the front panel opening 18. In the closed position, as shown, the door assembly 30 can seal against the front panel opening 18 or the bellows 32. The door assembly 30 can include a rotatable compartment 42 with hinges 44. Optionally, an actuator or sensor 46 can couple to or be in communication with the hinge 44 to provide a rotational portion of the rotatable compartment 42 relative to the door assembly 30.

Figure 4:
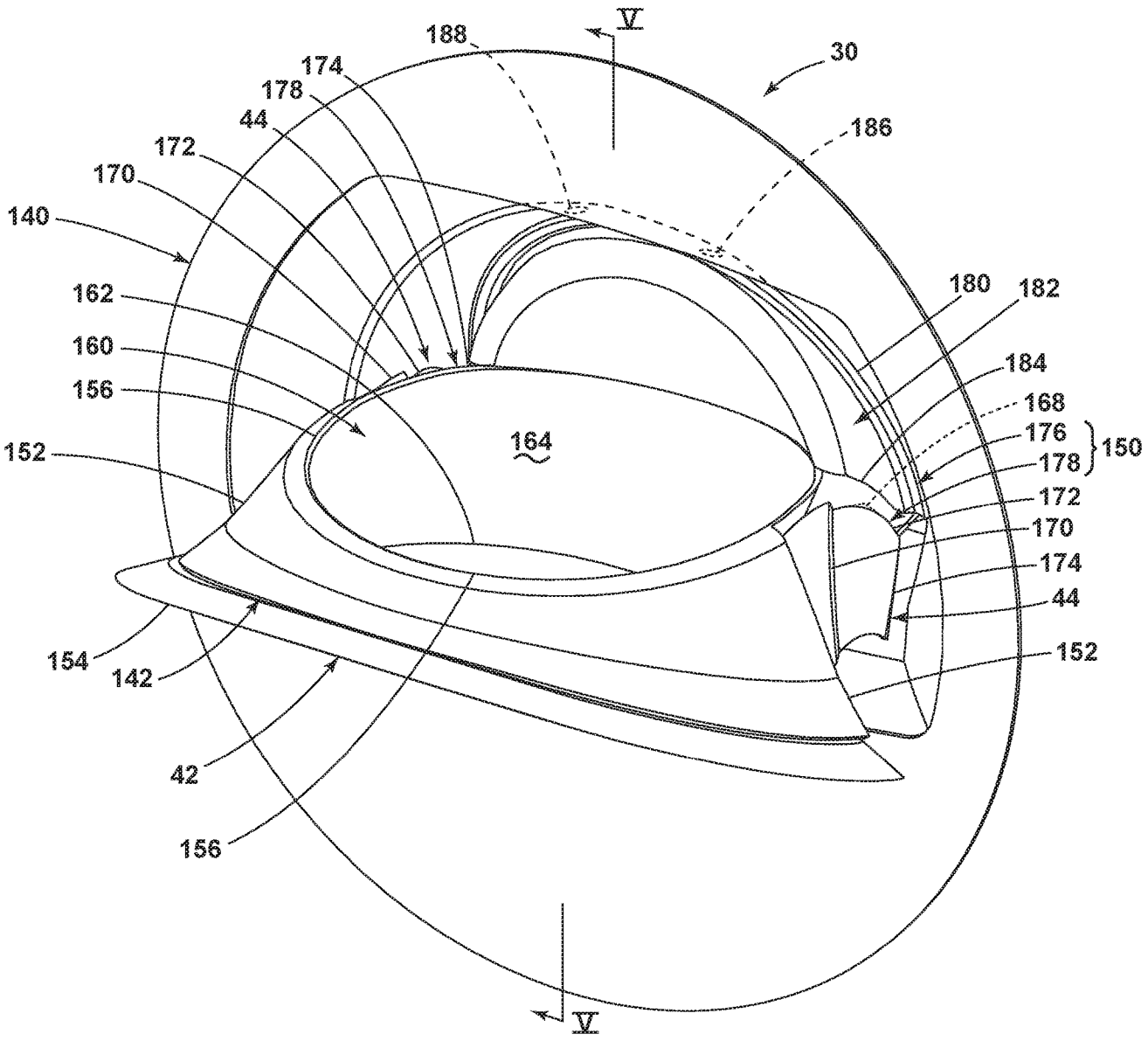
FIG. 4 is a perspective view of the portion of the door assembly of FIG. 3 with the rotatable compartment in an open position.

An actuator or sensor 40 can be used to open and close the rotatable compartment 42. By way of non-limiting example, the actuator or sensor 40 can be manually pressed to release the rotatable compartment 42 to an open position or pressed to secure the rotatable compartment 42 in the closed position. The actuator or sensor 40 can include a switch, lever, latch, button, or any other known method of triggering or allowing rotation of the rotatable compartment 42. It is contemplated that the actuator or sensor 40 can be located on any portion of the door assembly 30, cabinet 14, or a user interface 122. The rotatable compartment 42 moves, such as rotates, between a closed position, as illustrated, and an opened position (FIG. 4). It is further contemplated that the actuator or sensor 40 can be in communication with a controller 120.

Optionally, the laundry treating appliance can further include a liquid supply system for supplying water to the laundry treating appliance 10 for use in treating laundry during a cycle of operation. It is further contemplated that the liquid supply system can provide water to a location relative to the rotatable compartment 42. The liquid supply system can include a source of water, such as a household water supply 48, which can include separate valves 50 and 52 for controlling the flow of hot and cold water, respectively. Water can be supplied through an inlet conduit 54 directly to the tub 20 by controlling first and second diverter mechanisms 56 and 58, respectively. The diverter mechanisms 56, 58 can be a diverter valve having two outlets such that the diverter mechanisms 56, 58 can selectively direct a flow of liquid to one or both of two flow paths. Water from the household water supply 48 can flow through the inlet conduit 54 to the first diverter mechanism 56 which can direct the flow of liquid to a supply conduit 60. The second diverter mechanism 58 on the supply conduit 60 can direct the flow of liquid to a tub outlet conduit 62 which can be provided with a tub spray nozzle 64 configured to spray the flow of liquid into the tub 20. In this manner, water from the household water supply 48 can be supplied directly to the tub 20. While the valves 50, 52 and the inlet conduit 54 are illustrated exteriorly of the cabinet 14, it will be understood that these components can be internal to the cabinet 14.

The tub outlet conduit 62 can include a diverter mechanism 66 coupled to a prewash conduit 68. A prewash faucet 70 is fluidly connected to the prewash conduit 68 to provide water to an upper portion 71 of the door assembly 30 adjacent to the rotatable compartment 42. The diverter mechanism 66 can provide water to the tub 20, the rotatable compartment 42 via the door assembly 30, or both. However, it is contemplated that the prewash faucet 70 can be fluidly connect to the household water supply 48 using known combinations of valves, conduits, and fluid flow techniques. Alternatively, the prewash faucet 70 can be mounted to the cabinet 14 in such a way to provide treating chemistries to the rotatable compartment 42 via an outlet in the door assembly 30. A faucet actuator 72 can allow a user to selectively actuate, such as to activate or deactivate, the prewash faucet 70. The faucet actuator 72 can be in communication with the controller 120. It is contemplated that faucet actuator 72 can be located on any portion of the door assembly 30, cabinet 14, or the user interface 122.

The laundry treating appliance 10 can also optionally be provided with a dispensing system for dispensing treating chemistry to the treating chamber 22 for use in treating the laundry according to a cycle of operation. The dispensing system can include a treating chemistry dispenser 74 which can be a single dose dispenser, a bulk dispenser, or an integrated single dose and bulk dispenser and is fluidly coupled to the treating chamber 22. The treating chemistry dispenser 74 can be configured to dispense a treating chemistry directly to the tub 20 or mixed with water from the liquid supply system through a dispensing outlet conduit 76. The dispensing outlet conduit 76 can include a dispensing nozzle 78 configured to dispense the treating chemistry into the tub 20 in a desired pattern and under a desired amount of pressure. For example, the dispensing nozzle 78 can be configured to dispense a flow or stream of treating chemistry into the tub 20 by gravity, i.e. a non-pressurized stream. Water can be supplied to the treating chemistry dispenser 74 from the supply conduit 60 by directing the diverter mechanism 58 to direct the flow of water to a dispensing supply conduit 73.

The dispensing outlet conduit 76 can include a diverter mechanism 80 coupled to a prewash chemistry conduit 82. A prewash chemistry outlet 84 is fluidly connected to the prewash chemistry conduit 82 to provide treating chemistries to an upper portion 71 of the door assembly 30 adjacent to the rotatable compartment 42. The diverter mechanism 80 can provide treating chemistries to the tub 20, the rotatable compartment 42 via the door assembly 30, or both. However, it is contemplated that the prewash chemistry outlet 84 can be fluidly connected to the treating chemistry dispenser 74 using known combinations of valves, pumps, conduits, and fluid flow techniques. Alternatively, the prewash chemistry outlet 84 can be mounted to the cabinet 14 in such a way to provide treating chemistries to the rotatable compartment 42 via an outlet in the door assembly 30.

A dispenser actuator 85 can allow the user to selectively activate or deactivate the prewash chemistry outlet 84. The dispenser actuator 85 can be in communication with the controller 120 or the diverter mechanism 66. It is contemplated that dispenser actuator 85 can be located on any portion of the door assembly 30, cabinet 14, or the user interface 122.

The treating chemistry dispenser 74 can include multiple chambers or reservoirs fluidly coupled to the treating chamber 22 for receiving doses of different treating chemistries. The treating chemistry dispenser 74 can be implemented as a dispensing drawer that is slidably received within the cabinet 14, or within a separate dispenser housing which can be provided in the cabinet 14. The treating chemistry dispenser 74 can be moveable between a fill position, where the treating chemistry dispenser 74 is exterior to the cabinet 14 and can be filled with treating chemistry, and a dispense position, where the treating chemistry dispenser 74 is interior of the cabinet 14.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof.

The laundry treating appliance 10 can also optionally include a recirculation and drain system for optionally recirculating liquid within the laundry holding system and for draining liquid from the laundry treating appliance 10. Liquid supplied to the tub 20 through tub outlet conduit 62 and/or the dispensing outlet conduit 76 typically enters a space between the tub 20 and the drum 12 and can flow by gravity to a sump 86 formed in part by a lower portion of the tub 20. The sump 86 can also be formed by a sump conduit 88 that can fluidly couple the lower portion of the tub 20 to a pump 90. The pump 90 can direct liquid to a drain conduit 92, which can drain the liquid from the laundry treating appliance 10, or to a recirculation conduit 94, which can terminate at a recirculation inlet 96. The recirculation inlet 96 can direct the liquid from the recirculation conduit 94 into the drum 12. The recirculation inlet 96 can introduce the liquid into the drum 12 in any suitable manner, such as by spraying, dripping, or providing a steady flow of liquid. In this manner, liquid provided to the tub 20, with or without treating chemistry, can be recirculated into the treating chamber 22 for treating the laundry within.

The liquid supply and/or recirculation and drain system can be provided with a heating system which can include one or more devices for heating laundry and/or liquid supplied to the tub 20, such as a steam generator 98 and/or a sump heater 100. Liquid from the household water supply 48 can be provided to the steam generator 98 through the inlet conduit 54 by controlling the first diverter mechanism 56 to direct the flow of liquid to a steam supply conduit 102. Steam generated by the steam generator 98 can be supplied to the tub 20 through a steam outlet conduit 104. The steam generator 98 can be any suitable type of steam generator 98 such as a flow through steam generator or a tank-type steam generator. Alternatively, the sump heater 100 can be used to generate steam in place of or in addition to the steam generator 98. In addition or alternatively to generating steam, the steam generator 98 and/or sump heater 100 can be used to heat the laundry and/or liquid within the tub 20 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The laundry treating appliance 10 also includes a drive system for rotating the drum 12 within the tub 20. The drive system can include a motor 110 for rotationally driving the drum 12. The motor 110 can be directly coupled with the drum 12 through a drive shaft 112 to rotate the drum 12 about a rotational axis during a cycle of operation. The motor 110 can be a brushless permanent magnet (BPM) motor having a stator 114 and a rotor 116. Alternately, the motor 110 can be coupled with the drum 12 through a belt and a drive shaft to rotate the drum 12, as is known in the art. Other motors, such as an induction motor or a permanent split capacitor (PSC) motor, can also be used. The motor 110 can rotationally drive the drum 12 including that the motor 110 can rotate the drum 12 at various speeds in either rotational direction.

The control system can control the operation of the laundry treating appliance 10 to implement one or more cycles of operation. The control system can include a controller 120 located within the cabinet 14 and a user interface 122 that can be operably coupled with the controller 120. The user interface 122 can provide an input and output function for the controller 120. The user interface 122 can include one or more knobs, dials, switches, displays, touchscreens, and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection, and cycle parameters, such as cycle options. Other communications paths and methods can also be included in the laundry treating appliance 10 and can allow the controller 120 to communicate with the user in a variety of ways. For example, the controller 120 can be configured to send a text message to the user, send an electronic mail to the user, or provide audio information to the user either through the laundry treating appliance 10 or utilizing another device such as a mobile phone.

The controller 120 can include the machine controller and any additional controllers provided for controlling any of the components of the laundry treating appliance 10. For example, the controller 120 can include the machine controller and a motor controller. Many known types of controllers can be used for the controller 120. The specific type of controller is not germane to the present disclosure. It is contemplated that the controller can be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
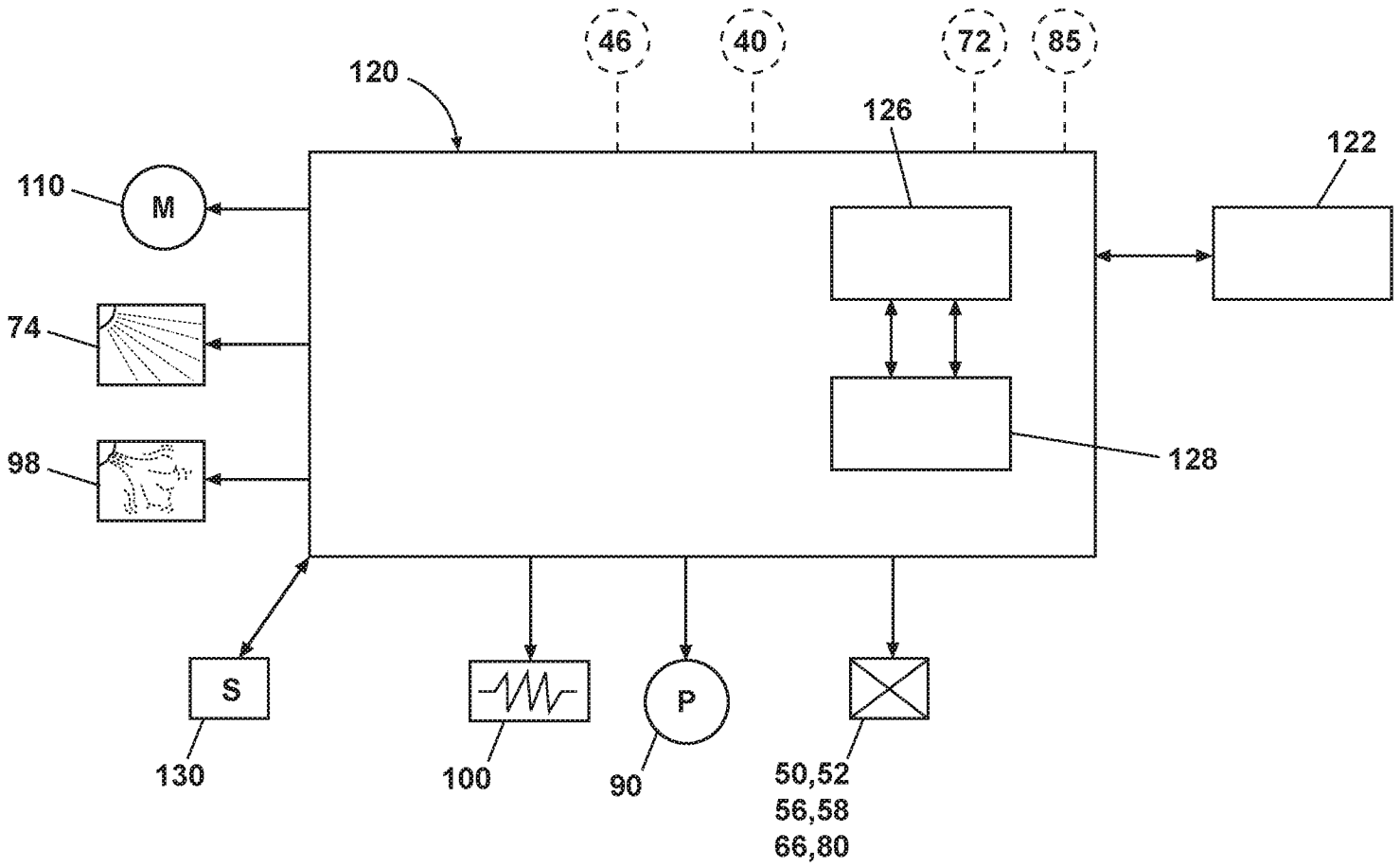
FIG. 2 is a schematic of a control system of the laundry treating appliance of FIG. 1.

As illustrated in FIG. 2, the controller 120 can be provided with a memory 126 and a central processing unit (CPU) 128. The memory 126 can be used for storing the control software that can be executed by the CPU 128 in completing a cycle of operation using the laundry treating appliance 10 and any additional software. For example, the memory 126 can store a set of executable instructions including at least one user-selectable cycle of operation. Examples, without limitation, of cycles of operation include: wash, heavy duty wash, delicate wash, quick wash, pre-wash, refresh, rinse only, and timed wash. The memory 126 can also be used to store information, such as a database or table, and to store data received from one or more components of the laundry treating appliance 10 that can be communicably coupled with the controller 120. The database or table can be used to store the various operating parameters for the one or more cycles of operation, including factory default values for the operating parameters and any adjustments to them by the control system or by user input.

The valves 50, 52, 56, 58, 66, 80 can be automatically or manually controlled by the controller 120. The controller 120 can provide the user selective activation of the diverter mechanism 66 or the prewash faucet 70 via the faucet actuator 72. Additionally, the controller 120 can provide the user selective activation of the diverter mechanism 80 or prewash chemistry outlet 84 via the dispenser actuator 85. Optionally, the faucet actuator 72, the dispenser actuator 85, or other sensors or actuators can be incorporated into or coupled to the user interface 122. It is contemplated that any valve or combinations of valves can be manually controlled via the user interface 122.

The controller 120 can be operably coupled with one or more components of the laundry treating appliance 10 for communicating with and controlling the operation of the component to complete a cycle of operation. For example, the controller 120 can be operably coupled with the motor 110, the pump 90, the treating chemistry dispenser 74, the steam generator 98 and the sump heater 100 to control the operation of these and other components to implement one or more of the cycles of operation.

The controller 120 can also be coupled with one or more sensors 130 provided in one or more of the systems of the laundry treating appliance 10 to receive input from the sensors 130, which are known in the art and not shown for simplicity. Non-limiting examples of sensors 130 that can be communicably coupled with the controller 120 include: a treating chamber temperature sensor, a moisture sensor, a weight sensor, a chemical sensor, a position sensor, an imbalance sensor, a load size sensor, and a motor torque sensor, which can be used to determine a variety of system and laundry characteristics, such as laundry load inertia or mass. Optionally, the controller 120 can couple to the actuator or sensor 46.

Figure 3:
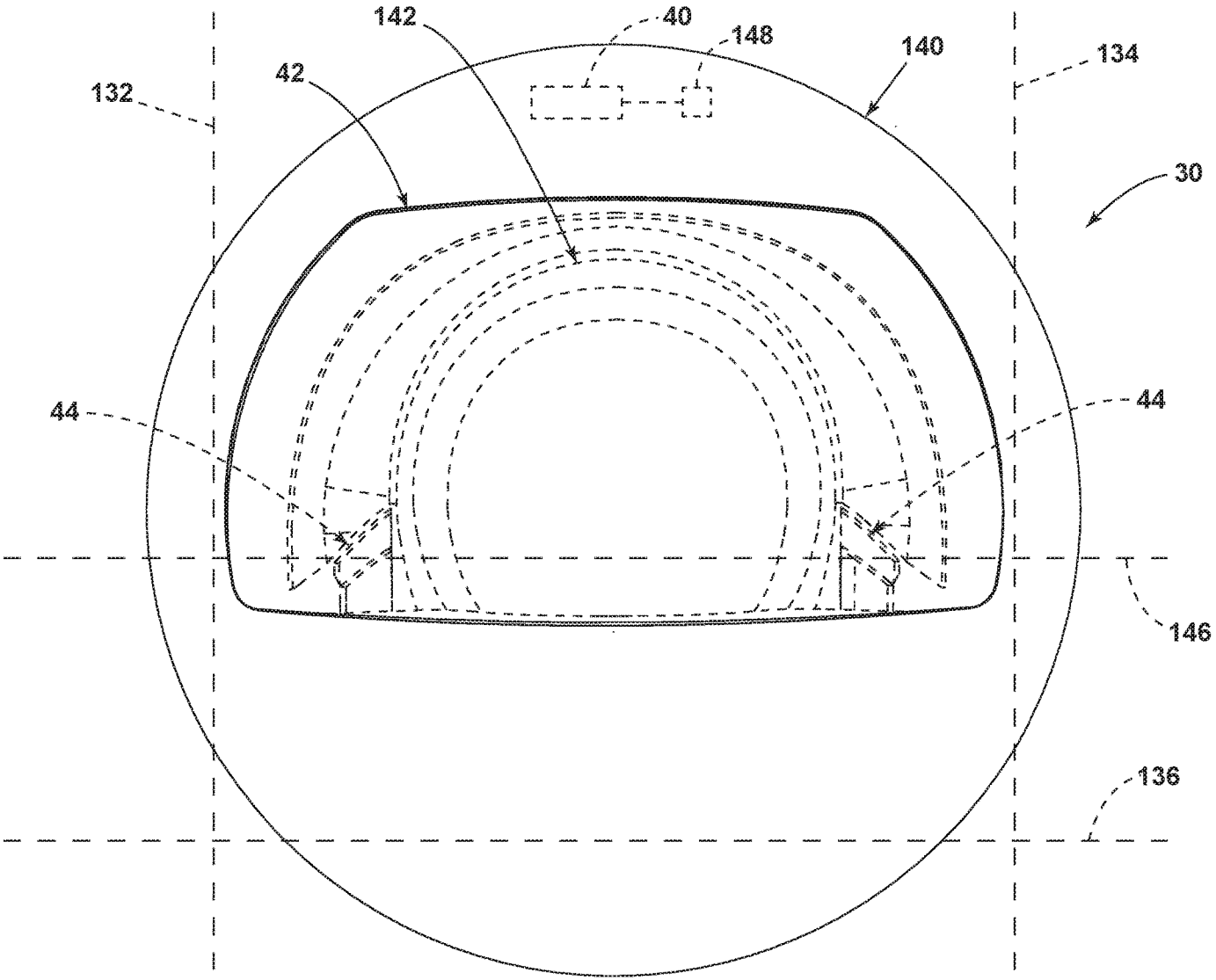
FIG. 3 is a front view of a portion of the door assembly of FIG. 1 with a rotatable compartment in a closed position.

FIG. 3 is front view of the door assembly 30 with the rotatable compartment 42 in the closed position. The door assembly 30 includes at least a closure element or door 140 movably mounted to the cabinet 14. The door 140 is illustrated by way of non-limiting example as generally circular. One or more possible door axes of rotation 132, 134, 136 can be used to rotatably separate the door assembly 30 from the cabinet 14.

By way of non-limiting example, a compartment axis 146 illustrates a possible axis of rotation for the rotatable compartment 42. Optionally a locking mechanism 148 can be positioned on the door assembly 30 to prevent unintentional opening of the rotatable compartment 42. It is contemplated that the actuation of the locking mechanism 148 can additionally or alternatively be located on the user interface 122, cabinet 14, or other location and can further be in communication with the controller 120.

FIG. 4 further illustrates the door assembly 30 when the rotatable compartment 42 is in the open position, exposing a basin 142 in an accessible position, with an open bowl 164 and a discouraging assembly 150. The basin 142 is carried by the rotatable compartment 42 and has an outside wall 152 rising from a front cover 154 of the rotatable compartment 42 to an apex 156. An inner wall 160 is defined from the apex 156 to a bottom portion 162 of the basin. The inner wall 160 and bottom portion 162 defines the open bowl 164 in which laundry items can be placed or loaded. The apex 156 can define at least a portion of the opening or access channel of the open bowl 164.

Receiving portions 170 of the hinge 44 are coupled to at least a portion of the outside wall 152 of the basin 142. Penetrating portions 172 of the hinge 44 extend from the door 140. The receiving portion 170 translates to receive the penetrating portions 172 as the rotatable compartment 42 is rotated to a closed position. Ridge elements 174 of the penetrating portions 172 can abut the receiving portions 170 when the rotatable compartment 42 reached the closed position. The receiving portion 170 translates to expose a portion of the penetrating portions 172 as the rotatable compartment 42 is opened. The penetrating portions 172 or the ridge elements 174 can couple to or be formed as part of at least one portion of the door 140.

The discouraging assembly 150 discourages or deflects fluids or objects from entering or exiting the tub 20 when the rotatable compartment 42 in the open position. The discouraging assembly 150 includes a top deflector 176 and side deflectors 178. A secured edge or upper edge 180 of the top deflector 176 couples to the door 140. A top deflector body 182 extends from the upper edge 180 to an exposed edge or lower edge 184. When the rotatable compartment 42 is in the open position, at least a portion of the apex 156 of the basin 142 is in contact with at least a portion of the lower edge 184 of the top deflector 176. The top deflector body 182 can be contoured, curved, or otherwise shaped to discourage or deflect fluids or objects from entering or exiting the tub 20 from a region above the basin 142.

Side deflectors 178 of the discouraging assembly 150 can be defined in part by the hinge 44. Optionally, portions of the door assembly 30 or basin 142 can also define a portion of the side deflectors 178. The side deflectors 178 discourage or deflect fluids or objects from entering or exiting the tub 20 in a region adjacent to the outside wall 152 of the basin 142.

A detent 168 can be located on one or more hinge 44 to provide a stable position of the rotatable compartment 42 that is between open and closed. The detent 168 is illustrated, by way on non-limiting example, as a protrusion on at least one of the penetrating portions 172. It is contemplated that the shape, style, or device can be used to provide a stable position of the rotatable compartment 42 that is between open and closed. Examples of possible detents include, but are not limited to, a propping device, a rotatable protrusion, a wedge, molded in plastic detent, spring loaded ball feature, all-inclusive spring and detented cam hinge assembly mounted in alignment with the axis of the rotatable compartment 42, or a push-push latch or knob that simply pushes the door assembly 30 or the rotatable compartment 42 out to create a gap. It is further contemplated that the detent 168 can be located at any position on the door 140, the hinges 44, or the rotatable compartment 42. Alternatively, the detent 168 can further encourage the rotatable compartment 42 to remain in the open position.

The door 140 can further include a water outlet 186 or a detergent outlet 188. The water outlet 186 can be a component of, couple to, or fluidly connect to the prewash faucet 70. The detergent outlet 188 can be a component of, couple to, or fluidly connect to the prewash chemistry outlet 84. It is contemplated that the water outlet 186 or the detergent outlet 188 can be located at position such that water or treating chemistry from the water outlet 186 or the detergent outlet 188 is directed to basin 142.

Figure 5:
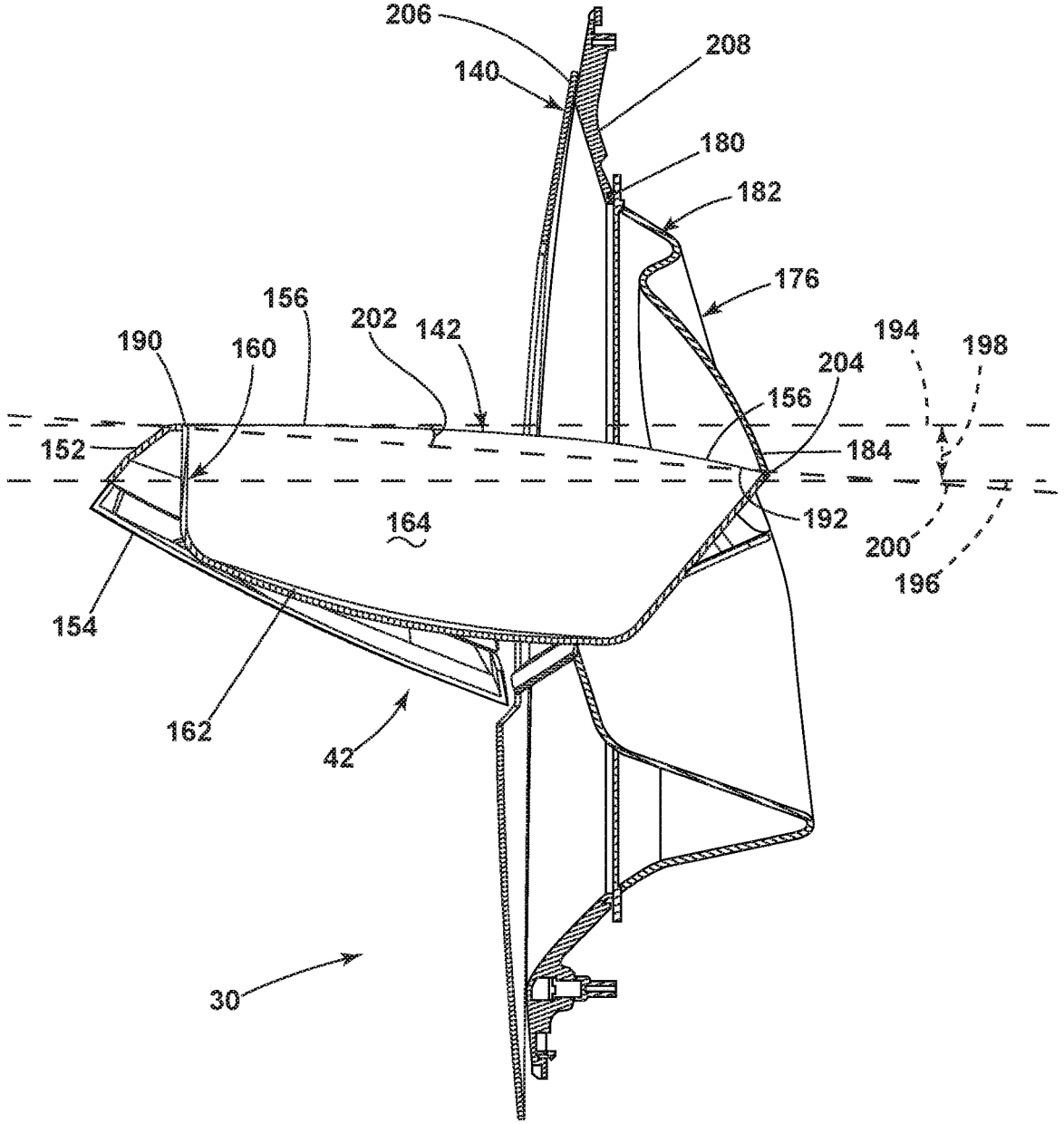
FIG. 5 is a cross section of the portion of the door assembly of FIG. 4 with the rotatable compartment in an open position.

FIG. 5 is a cross section from FIG. 4 to further illustrate the basin 142 and the top deflector 176. The apex 156 of the basin 142 can have a proximal end 190 and a distal end 192, which can further be thought of as the basin 142 having a front edge 190 and a rear edge 192. A first horizontal reference line 194 can be drawn through the proximal end 190. A second horizontal reference line 196 can be drawn through the distal end 192, illustrating a distance 198 between the first and second horizontal reference lines 194, 196, where the second horizontal reference line 196 is below the first horizontal reference line 194. That is, a connecting line 200 from the proximal end 190 to the distal end 192 of the apex 156 generates a non-zero angle 202 from the first horizontal reference line 194.

While portions of the lower edge 184 of the top deflector 176 are in contact with portions of the apex 156, a gap 204 can exist between portions of the lower edge 184 and the apex 156. The gap 204 can be defined by a portion of the lower edge 184 and the apex 156 where the lower edge 184 and the apex 156 are not in contact with each other.

The door 140 can include an outer frame 206 and an inner frame 208. The top deflector 176 can be coupled to the inner frame 208 via the secured edge or upper edge 180. Alternatively, the top deflector 176 can be formed as part of the inner frame 208.

Figure 6:
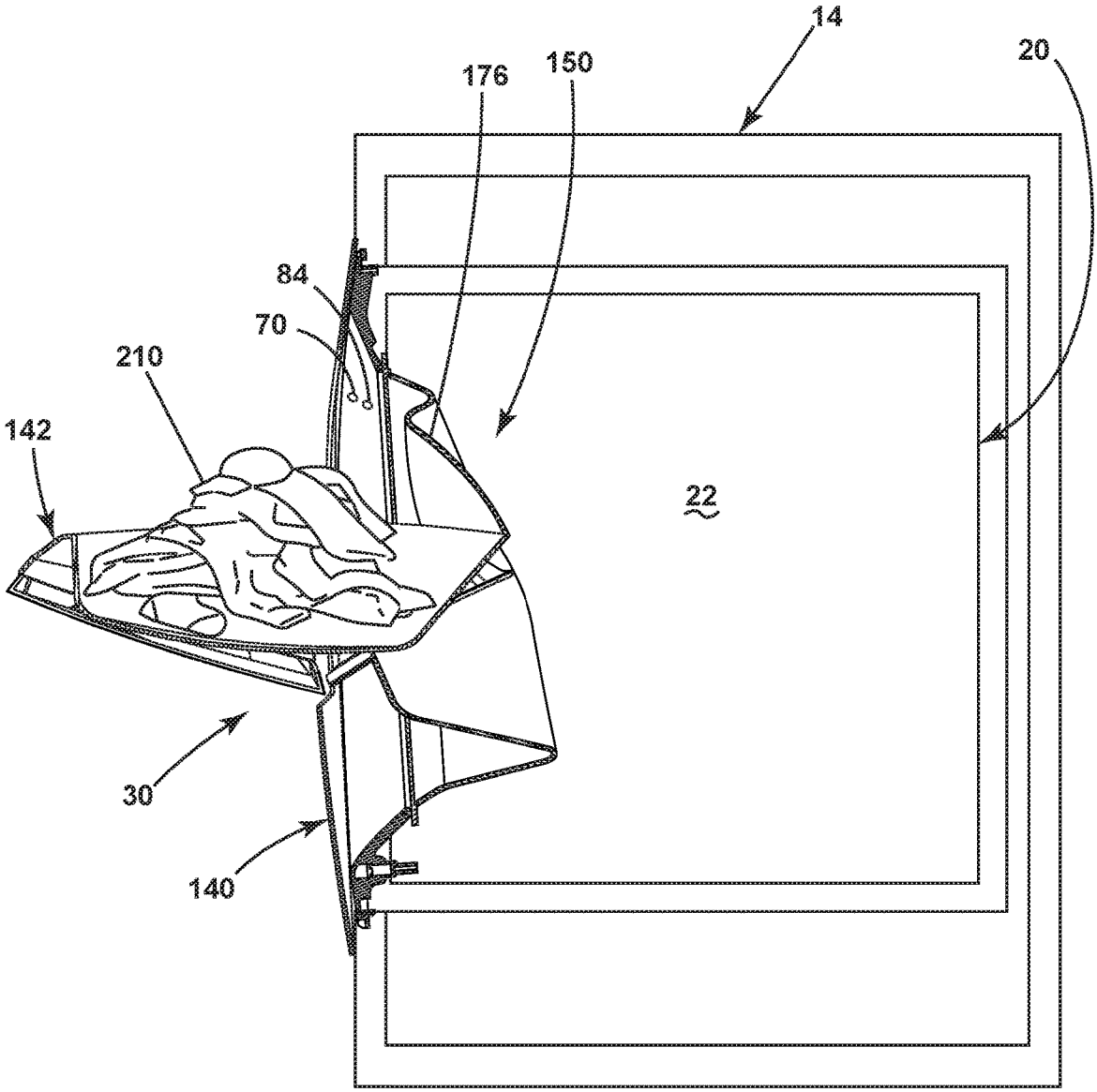
FIG. 6 is a schematic view of the laundry treating appliance of FIG. 1 with the rotatable compartment in the open position.

FIG. 6 schematically illustrates a laundry item 210 received by the basin 142 with the rotatable compartment 42 in the opened position and the basin 142 in the accessible position where the basin 142 is open to an exterior of the door 140. The discouraging assembly 150 discourages the laundry item 210 from entering the treating chamber 22 of the tub 20. The pretreatment faucet 70 or the prewash chemistry outlet 84 can provide fluid or treating chemistries to the basin 142 or laundry item 210. Excess fluid or treating chemistries can flow through the gap 204 to prevent overflow of fluid or treating chemistry from the basin 142.

Figure 7:
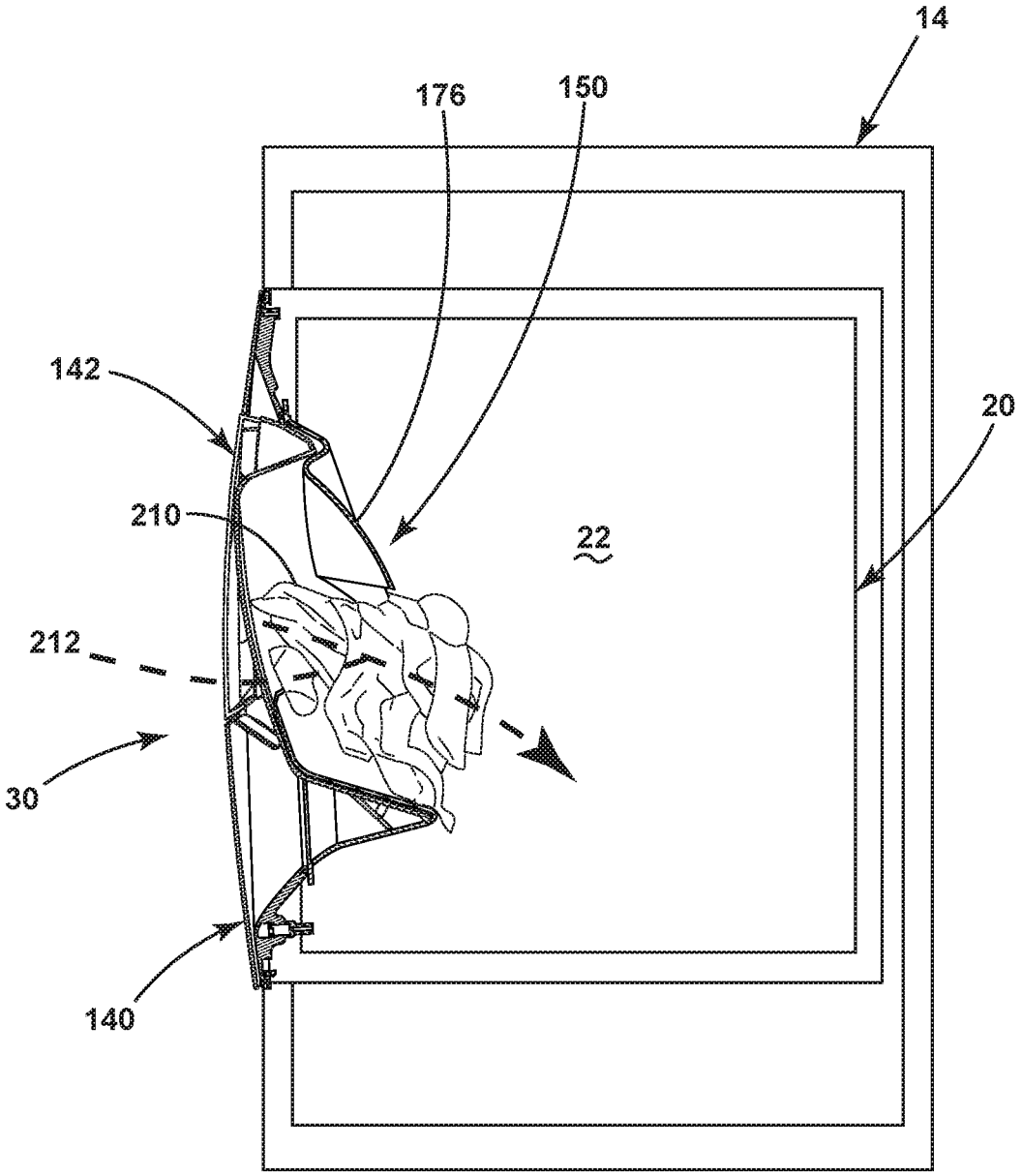
FIG. 7 is a schematic view of the laundry treating appliance of FIG. 6 with the rotatable compartment in the closed position.

FIG. 7 schematically illustrates the laundry item 210 received by the treating chamber 22 of the tub 20 from the basin 142 when the rotatable compartment 42 is in the closed position, placing the basin 142 in a non-accessible position. Optionally, fluids and treating chemistries from the basin 142 also enter the treating chamber 22 of the tub 20 when the rotatable compartment 42 is in the closed position and the basin 142 is at least partially open to the treating chamber 22. Arrow 212 illustrates a possible path of travel for the laundry item 210 from the basin 142 to the treating chamber 22.

In operation, the door assembly 30 and the rotatable compartment 42 are in the closed position. The user can press or otherwise activate the actuator or sensor 40 to open the rotatable compartment 42. The rotatable compartment 42 of the laundry treating appliance 10 can be opened prior to or during a cycle or operation. The discouraging assembly 150 discourages objects or fluids from entering or exiting the tub 20 when the rotatable compartment 42 is open or opening, therefore cycles of operation do no need to be paused or stopped.

Once the rotatable compartment 42 is open the user can place laundry items in the open bowl 164 of the basin 142, as illustrated schematically in FIG. 6. Optionally, the user can pretreat the laundry items by activating the prewash faucet 70 or the prewash chemistry outlet 84. The apex 156 of the basin 142 has the non-zero angle 202 so that as water or treating chemistries fill the open bowl 164, they can flow from the distal end 192 via the gap 204 into the tub 20.

When the user is done with pretreatment, or elects not to pretreat, the laundry items in the open bowl 164 can be added to the tub 20 by closing the rotatable compartment 42, as illustrated schematically in FIG. 7.

Benefits and advantages include, but are not limited to, the ability to add laundry items to a cycle of operation without having to stop or pause the cycle of operation. Often, in order to add a garment or laundry item to a cycle, a user must wait for the cycle to pause, as the door to the laundry treating appliance is often locked. The discouraging assembly allows for a user to access the basin in the rotatable compartment 42 during a cycle of operation. Laundry items can then be placed into the open bowl of the basin. When the rotatable compartment 42 is closed, the contents of the open bowl of the basin are added to the tub.

Another advantage includes the ability to pretreat laundry items and add them directly to the tub without having to carry them from a pretreatment location to the tub of the laundry treating appliance. Often carrying a pretreated item from a pretreatment location to the tub results water or treating chemistry on the floor or in another container. Using the basin, the user can pretreat laundry items and add them to the tub by closing the rotatable compartment. This can save the user time and reduce mess or contamination.

The prewash faucet can also remove the need for a separate sink or separate water access point, as the prewash faucet couples to the same household water inlet as the laundry treating appliance. Having access to a prewash faucet housed within the laundry treating appliance can save space as an additional pretreating area is not needed. The prewash faucet integrated into the laundry treating appliance can also provide a time saving benefit or cost benefit for the user.

Opening the rotatable compartment takes up less working space around the laundry treating appliance than opening the door assembly. This provides ventilation with a space saving benefit. The detent can provide ventilation with an even smaller workspace space requirement as the detent holds the rotatable compartment in a position between open and closed; allowing ventilation of the tub with minimal protrusion of the laundry treating appliance into a room.

To the extent not already described, the different features and structures of the various aspects of the present disclosure can be used in combination with each other as desired. That one feature may not be illustrated in all of the aspects of the disclosure is not meant to be construed that it cannot be, but is done for brevity of description. Thus, the various features of the different aspects of the present disclosure can be mixed and matched as desired to form new aspects, whether or not the new aspects are expressly described. All combinations or permutations of features described herein are covered by this disclosure.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure. Hence, specific dimensions and other physical characteristics relating to the aspects of the present disclosure are not to be considered as limiting, unless expressly stated otherwise.

What is claimed is:

1. A laundry treating appliance comprising:

a chassis defining an interior and having a front panel defining a front panel opening;

a rotatable treating chamber located within the interior and accessible through the front panel opening;

a door assembly movably mounted to the chassis for movement between opened and closed positions to selectively open or close the front panel opening;

a compartment movably mounted to the door assembly for movement between opened and closed positions; and a basin carried by the compartment such that, when the compartment is in the opened position, the basin is in an accessible position, where the basin is open to an exterior of the door assembly and laundry items can be loaded into the basin, and at least a portion of the basin contacts at least a portion of the door assembly to discourage fluids or objects from entering or exiting the treating chamber, even during a cycle of operation, and when the compartment is in the closed position, the basin is in a non-accessible position, where the basin is open to the treating chamber.

2. The laundry treating appliance of claim 1 wherein the compartment is rotatably mounted to the door assembly for movement between the opened and closed positions.

3. The laundry treating appliance of claim 1 further comprising an actuator coupling the compartment to the door assembly to selectively actuate movement of the compartment between the closed and the opened positions.

4. The laundry treating appliance of claim 1 further comprising a faucet that is oriented to emit liquid into the basin when the basin is in the accessible position.

5. The laundry treating appliance of claim 4 further comprising a faucet actuator operably coupled to the faucet for selective actuation of the faucet.

6. The laundry treating appliance of claim 5 wherein the faucet actuator is located on the door assembly, a cabinet, or a user interface such that it is physically accessible exteriorly of the laundry treating appliance when the basin is in the accessible position.

7. The laundry treating appliance of claim 1 wherein the basin has a front edge and a rear edge, the rear edge having a position that is lower than the front edge when the basin is in the accessible position.

8. The laundry treating appliance of claim 1 wherein the basin is an open bowl comprising an apex defining at least a portion of an access opening of the open bowl.

9. The laundry treating appliance of claim 8 wherein the apex includes a proximal end and a distal end, with the distal end nearest the treating chamber when the compartment is in the opened position.

10. The laundry treating appliance of claim 9 wherein the door assembly further comprises a discouraging assembly that discourages fluids or objects from entering or exiting the treating chamber when the compartment is in the opened position.

11. The laundry treating appliance of claim 10 wherein the discouraging assembly comprises a deflector body extending between the door assembly and the distal end of the apex of the basin when the compartment is in the opened position.

12. The laundry treating appliance of claim 11 wherein the deflector body contacts at least a portion of the apex of the basin to discourage the fluids or objects from entering or exiting the treating chamber even during the cycle of operation.

13. A laundry treating appliance comprising:

a chassis defining an interior and having a front panel defining a front panel opening;

a rotatable treating chamber located within the interior and accessible through the front panel opening; and a door assembly movably mounted to the chassis for movement between opened and closed positions to selectively open or close the front panel opening, the door assembly comprising:

a compartment movably mounted to the door assembly for movement between opened and closed positions;

a basin carried by the compartment such that, when the compartment is in the opened position, the basin is in an accessible position where the basin is open to an exterior of the door assembly and laundry items can be loaded into the basin, and when the compartment is in the closed position, the basin is in a non-accessible position where the basin is open to the treating chamber; and a deflector body extending between the door assembly and the basin such that at least a portion of the basin contacts at least a portion of the deflector body when the basin is in the accessible position to discourage fluids or objects from entering or exiting the treating chamber even during a cycle of operation.

14. The laundry treating appliance of claim 13 wherein the compartment is rotatably mounted to the door assembly for movement between the opened and closed positions.

15. The laundry treating appliance of claim 13 further comprising a faucet that is oriented to emit liquid into the basin when the basin is in the accessible position.

16. The laundry treating appliance of claim 13 wherein the basin is an open bowl comprising an apex defining at least a portion of an access opening of the open bowl.

17. The laundry treating appliance of claim 16 wherein the apex includes a proximal end and a distal end, with the distal end nearest the treating chamber when the compartment is in the opened position.

18. The laundry treating appliance of claim 17 wherein the deflector body extends between the door assembly and the distal end of the apex of the basin when the compartment is in the opened position.

19. The laundry treating appliance of claim 18 wherein the deflector body contacts at least a portion of the apex of the basin to discourage the fluids or objects from entering or exiting the treating chamber even during the cycle of operation.

20. The laundry treating appliance of claim 13 further comprising an actuator coupling the compartment to the door assembly to selectively actuate movement of the compartment between the closed and the opened positions.

* * * * *